US006059104A

United States Patent [19]

Widman

[11] Patent Number: 6,059,104

[45] Date of Patent: May 9, 2000

[54] CORNER SUPPORT POST

[75] Inventor: Donald E. Widman, Nashville, Tenn.

[73] Assignee: Sonoco Products Company, Hartsville, S.C.

[21] Appl. No.: 09/262,321

[22] Filed: Mar. 4, 1999

[51] Int. Cl.[7] ..... B65D 81/02

[52] U.S. Cl. ..... 206/320; 206/586; 206/591

[58] Field of Search ..... 206/453, 586, 206/591, 592, 594, 576, 320

[56] References Cited

U.S. PATENT DOCUMENTS 3,734,389 5/1973 Brown .

4,483,444 11/1984 Gardner ..... 206/586 X 5,267,651 12/1993 Hughes .

5,328,033 7/1994 Ptaschinski ..... 206/586

5,593,039 1/1997 Ortlieb .

*Primary Examiner*—Jacob K. Ackun

*Attorney, Agent, or Firm*—Dennison, Scheiner, Schultz & Wakeman

[57] ABSTRACT

A corner support post having a first section of trapezoidal cross-section and a second section rectangular in cross-section. Both sections are formed by a single continuous wall structure with the rectangular section offset longitudinally and laterally from the smaller end of the first section with a right angular offset defined therebetween.

15 Claims, 2 Drawing Sheets

CORNER SUPPORT POST

BACKGROUND OF THE INVENTION

In the packaging of heavy, bulky products, particularly home appliances having easily damaged exterior walls, such as washers, dryers, refrigerators, and the like, it is a common procedure to provide support posts at and engaged with the vertical corners of the appliance, and may extend to the full height thereof. A protective carton or box is also normally provided to enclose the appliance and corner engaged support posts. Such protective boxes can comprise as little as a wrap of heavy duty plastic or other appropriate material, or a complete corrugated cardboard carton, with the main purposes being to retain or assist in retaining the positioned support posts, and to protect the exterior of the appliance against surface scratches and possible exposure to the elements.

Support posts of the type herein involved are usually constructed of convolutely wound paperboard tubes which are transversely formed to the desire post configuration. Thus formed, the support posts provide both stacking strength where necessary and lateral strength for the protecting and cushioning of the packaged product. Such protection against lateral or transverse forces is particularly desirable in light of the forces normally applied to the package during the handling and transport thereof, and the necessity of accommodating such forces without affecting the vertical compressive strength of the posts which, preferably, is sufficient to accommodate stacked products.

Two forms of known support or corner posts will be seen in the following U.S. patents, commonly assigned with the present invention:

| | |
|---|---|
| Hughes | 5,267,651 |
| Ortleib | 5,593,039 |

In both of these patents, the disclosed support posts, to maintain the strength thereof, rely on a controlled collapsing of the cushioning bead to form multiple layers between and in addition to the outer walls. In Ortleib, provision is made for the accommodation of protrusions, such as a handle, on the appliance. However, in Ortleib, as the major line of force will be directed along the space between the product and the side of the enclosing box, there is a tendency for pressure on the front of the box to shift the product away from the side of the box or wrap and reduce the ability of the front bead to withstand pressure.

SUMMARY OF THE INVENTION

The present invention is concerned with a corner post construction which further advances the art in providing a structure particularly capable of maintaining an intimate engagement with the corner of the appliance and the enclosing box to each side of the corner. In doing so, the post retains a high degree of both lateral and vertical compressive strength as laterally directed compressive forces are applied against and cushioned by the post.

Structurally, the post is preferably formed from a wound paperboard tube which is transversely configured to the desired post configuration.

The formed post may be of a length greater than the height of the product or appliance to be packaged so as to accommodate vertical compressive loads, as in stacking, without requiring a direct bearing of the load by the appliance. The post, vertically positioned in use and engaging a corner and the two adjacent faces of the appliance forming the corner, defines two full length and laterally adjacent hollow cushioning sections adapted to engage respectively against the two corner-defining faces immediately adjacent the corner and to extend outward therefrom to the encircling protective carton. The sections include a first enlarged section of trapezoidal configuration and a second smaller section of a generally square configuration. The sections are defined by a first inner wall having a right angular offset area which embraces the appliance corner and sufficiently overlaps a face of the appliance to transmit force received on an outer parallel panel of the first section primarily to the appliance face to maintain a stable relationship between the post and the appliance for maximum utilization of the cushioning effect of the larger section. The post is further defined by a second outer wall forming an inclined side or side panel of the larger trapezoidal section and terminating, slightly beyond the appliance seating inner wall offset, in angularly related wall panels or portions which define the smaller cushioning section. The relationship between these sections is such as to cushion laterally applied forces while maintaining the stability and strength of the post, in large part by retaining the basic tubular configurations for the cushioning sections.

Other features of the invention will become apparent from the more detailed description following hereinafter.

DESCRIPTION OF PREFERRED EMBODIMENT

Figure 1:
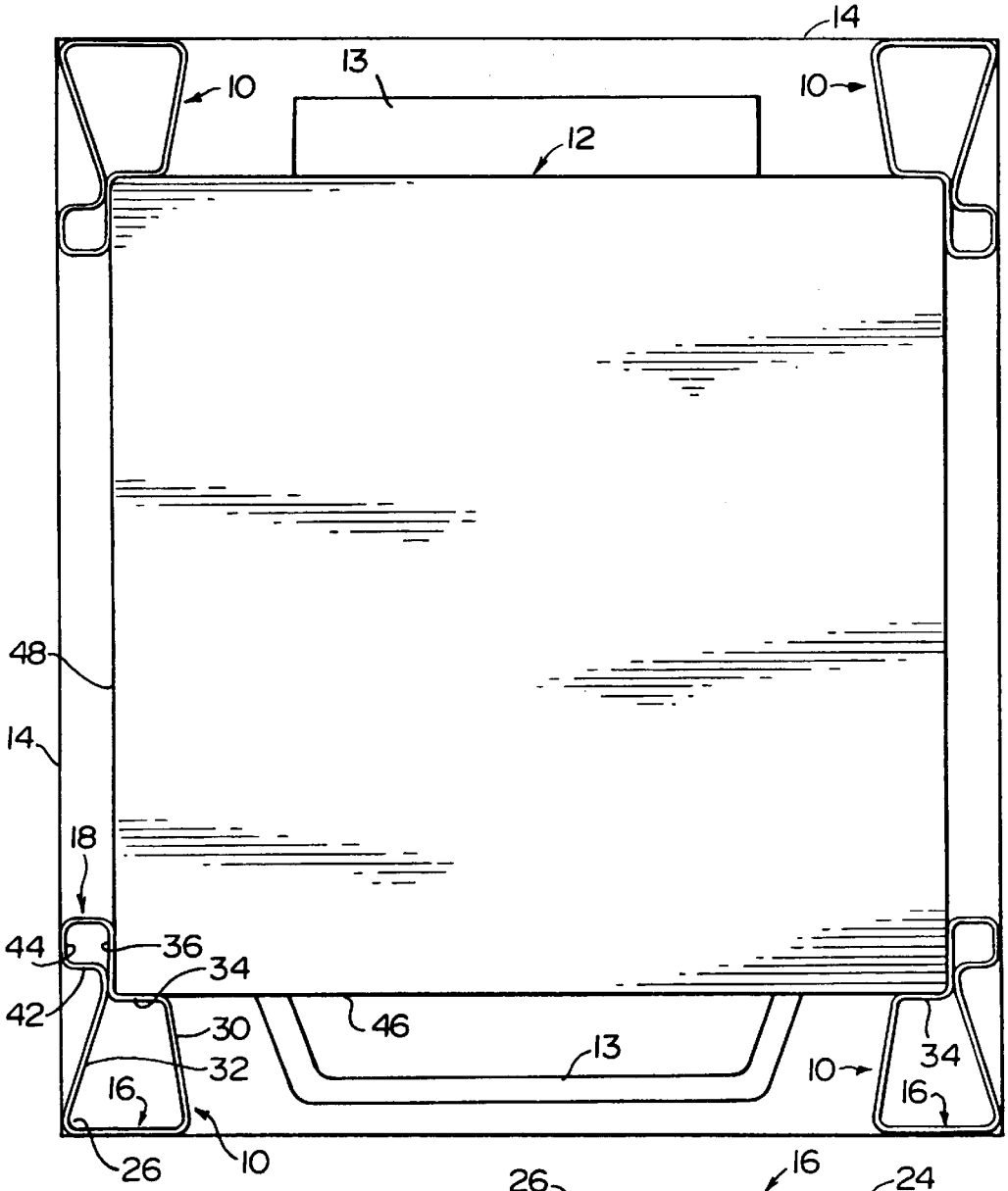
FIG. 1 is a top plan view of a product package with the protective top cap removed and illustrating the positioning of the corner support posts of the invention.
Figure 2:
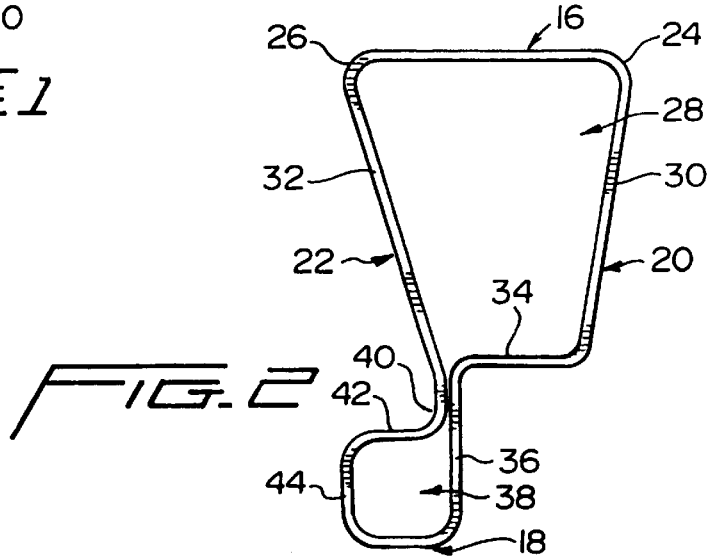
FIG. 2 is an enlarged top plan view of the corner post.
Figure 3:
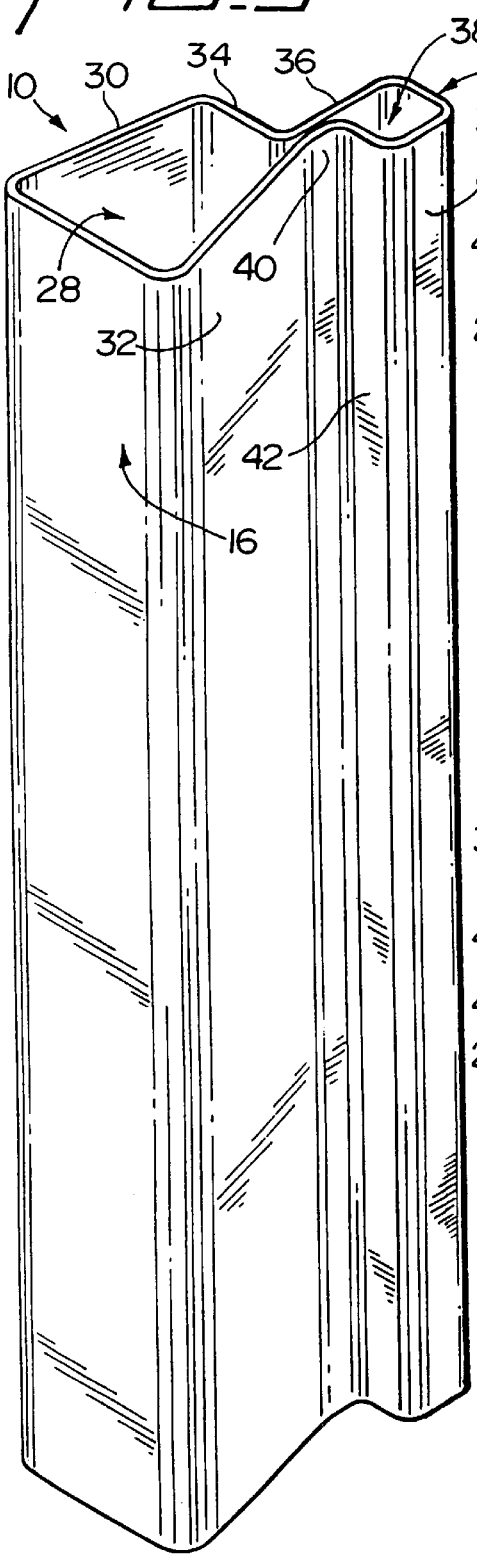
FIG. 3 is an enlarged perspective view of the corner post.

Referring now more specifically to the drawings, FIG. 1 illustrates four corner support posts 10 engaging the corners of, and stabilizing, a product 12 within a packaging carton or box 14. The packaging box 14 in turn stabilizes and retains the support posts 10 in position to confine and cushion the product 12 and accommodate any protrusions, such as a handle 13 thereon. The support posts will normally extend vertically between a lower support platform and a top cap (not illustrated).

The support posts 10, preferably made from a wound paperboard tube formed to the desired cross-sectional configuration, provides both longitudinal compressive strength to allow for stacking, and an enhanced capability to cushion and accommodate lateral compressive forces while maintaining effective stacking strength.

More particularly, the post 10 includes generally parallel first and second end walls 16 and 18 integrally joined by first inner and second outer side walls 20 and 22.

The side walls 20 and 22 extend from the opposed ends of the end wall 16, each at an acute inner angle thereto to form outer corners 24 and 26 of both the post and a first large, full length, hollow outer support and cushioning section 28. The opposed sides of the section 28 comprise side wall panels 30 and 32 defined by the converging side walls 20 and 22 respectively. The first larger section 28 is completed by a right angular offset formed in said first side wall 20 and defining a laterally directed inner end panel 34 extending, substantially parallel to the end wall 16, across the narrow end of the section 28 defined by the converging side panels 30 and 32. Thus formed, the first section 28 is of a trapezoidal configuration.

The first side wall 20 continues from the inner end panel 34, at right angles thereto, to one edge of the second end wall 18, thereby defining a side panel 36 of a second smaller inner section 38. The side wall 22, beyond the laterally extending inner end panel 34 of the section 28, parallels the first side wall 20 immediately adjacent thereto at a small transition area 40 between the sections whereat a sliding relationship is provided between the side walls as shall be referred to subsequently. Immediately beyond this transition area 40, the side wall 22 is laterally outwardly directed, relative to the side wall 20, to define an inner panel 42 of the second smaller section 38 which generally parallels the end wall 18. The side wall 22, at the outer end of the laterally directed end panel 42, extends at substantially right angles to the end panel 42 and defines a second side panel 44, generally parallel to side panel 36, which integrally joins, at approximately a right angle thereto, the end wall 18, thereby completing the generally square or rectangular configuration of the smaller section 38.

The second side panel 44 of the section 38 is substantially linearly aligned with the outer corner 26 of the first section 28 defined by the first section side panel 32 and end wall 16.

The first side panel 36 of the small section 38 is in a plane generally aligned with a corner of the larger section defined by the wall panel 32 and inner end panel 34 of this larger section. As such, the side panel 36 is in a plane offset from the central plane of the section 28 closer to the second post side wall 22. This is significant in that upon the introduction of an external force to the end wall 16, a major component of this force will be transmitted directly to the face 46 of the product or appliance 12 against which the inner end panel 34 seats, rather than along the adjoining right angle face 48 which would tend to cause a tipping away of the post from the first face 46, a reduced resistance to collapsing of the first section of the post, and a possible reduction in the lateral protection along the side of the product.

Figure 4:
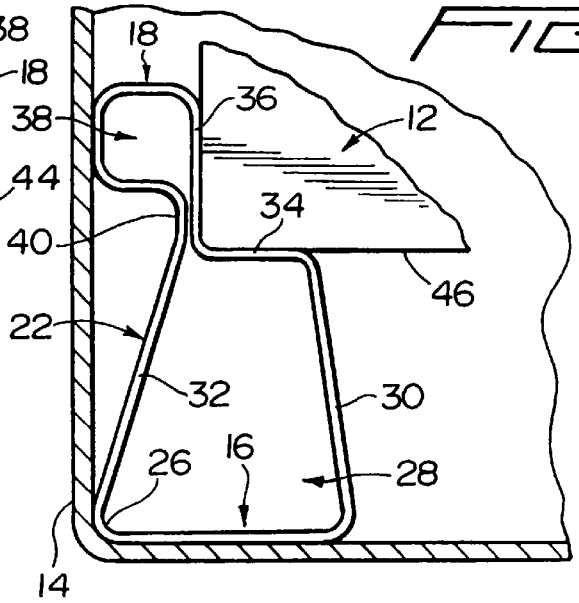
FIG. 4 is an enlarged cross-sectional detail illustrating the post mounted in position between a product and surrounding support box prior to the introduction of any compressive forces.
Figure 5:
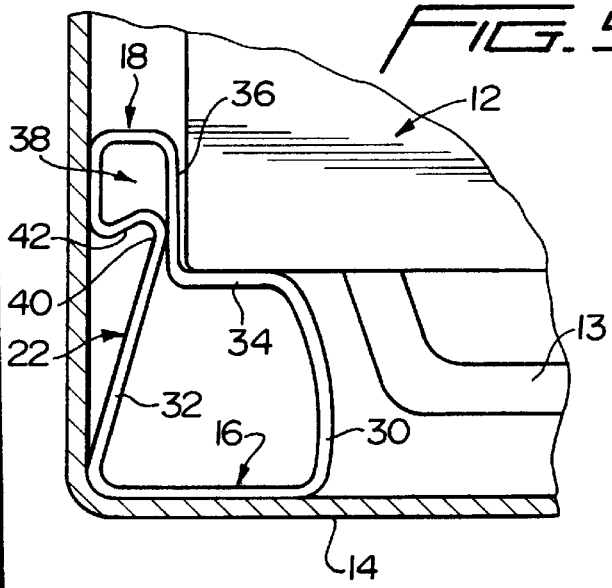
FIG. 5 is a similar view with the post under a lateral compressive loading.

With reference to FIGS. 4 and 5, it will be seen that the larger section 28, when subjected to a lateral compressive force acting on the outer end wall 16 and the opposed inner end panel 34, normally when the package is being moved, will provide a predetermined cushioning resistance with the side panel 30 bowing outward in a controlled manner. Basically the load of the product 12 moving relative toward the outer end wall 16 of the post, will cause a controlled outward arcuate bending or bowing of the inclined side panel 30. Such an outward bowing is encouraged by locating the relatively shorter end panel 34 generally centrally aligned with the longer end wall 16 whereby the main resultant component of the force resulting from movement of the product relative to the box front wall is inward of the inclined panel 30.

Any excess loading force beyond that anticipated and normally accommodated by the controlled bending of the side panel 30 will tend to be dissipated along the side and toward smaller section 38. Under such excess loading, the side panel 36 of the smaller section 38 tends to move toward the end wall 16, sliding relative to the post side wall 22 at the transition area 40 and causing a slight change in the rectangular configuration of the smaller section 38, while retaining the general overall volume and position thereof between the product and sleeve, thus preserving the lateral and longitudinal strength thereof for both cushioning and support.

It will also be noted that the larger section 28 is retained as a hollow tubular bead firmly engaged within the corner of the outer protective box and with the corresponding corner of the product to retain substantial lateral and longitudinal strength and a continued cushioned protection of the product even under extreme conditions. The inner end panel 34 remains in intimate contact with the product and continues to provide a cradle-like support allowing for slight shifting of the product without damage thereto. Incidentally, the two post walls 20 and 22 will normally be in actual sliding engagement with each other at the transition area 40. The slight spacing shown in the drawings is for illustrative purposes only although the inherent flexible resilient nature of the material of the post may in fact cause such a spacing.

The foregoing is considered illustrative of the features of the invention. As variations of the described embodiment may occur to those knowledgeable in the art, the invention is to be limited only by the scope of the claims appearing hereinafter.

I claim:

1. A corner support post for a product packaging system, said support post having a length and a width defined by substantially coextensive first and second side walls generally in laterally spaced relation to each other, said post, across the width thereof, comprising inner and outer transversely aligned substantially coextensive hollow sections extending along the length of said post, said first and second side walls having opposed longitudinal edges, first and second transverse end walls joining corresponding edges of said side walls and respectively defining outer end panels of said inner and outer sections, said first and second side walls converging toward each other from and at acute included angles to said first end wall to define first side panels forming said outer section, said first side wall, beyond said first side panel thereof, extending laterally generally parallel to said first end wall and toward said second side wall to define a second end panel of said outer section, said first side wall including a second side panel extending between said second end panel and said second end wall, said second side wall, inward of said first side panel thereof, extending laterally away from said first side wall to define a second end panel of said inner section, said second side wall including a second side panel extending between said second end panel of said inner section and said second end wall.

2. The support post of claim 1 wherein said end walls and said end panels are substantially parallel to each other.

3. The corner post of claim 2 wherein said second end panel of said outer section and said second side panel of said first side wall define a substantially right angle.

4. The corner post of claim 3 wherein said second side panel of said second side wall is linear, generally perpendicular to said first end wall, and aligned with said second side wall at the included angle with said first end wall.

5. The corner post of claim 4 wherein said first end wall is of a predetermined length, said second end panel of said first section being of a lesser length and aligned generally centrally of said first end wall.

6. The corner post of claim 5 wherein said first section is of a trapezoidal configuration of predetermined volume.

7. The corner post of claim 6 wherein said second section is of a rectangular configuration with a volume less than that of said first section.

8. A corner support post for product packaging, said support post having a length and a width defined by substantially coextensive first and second side walls in generally laterally spaced relation to each other, and transverse first and second end walls joined to and extending between said first and second side walls, said post, across the width thereof, comprising first and second transversely aligned substantially coextensive hollow sections extending along the length of said post, said first section being of generally trapezoidal configuration with side panels, defined by said first and second side walls, converging from said first end wall, an inner end panel defined by said first side wall and extending laterally toward said second side wall, said inner end panel being parallel to and spaced from said first end wall and aligned generally centrally thereof, said second section being of a generally rectangular configuration with opposed first and second side panels respectively defined by said first and second side walls and extending from said end panel, said second section including an inner end panel defined by said second side wall and extending laterally away from said first side wall.

9. The corner post of claim 8 wherein said inner end panel of said first section has an end laterally adjacent said second side wall, said second side panel of said second section extending to said end of said first section inner end panel.

10. The corner support post of claim 9 wherein said first section is of a predetermined volumetric size and said second section is of a smaller volumetric size.

11. The corner post of claim 10 wherein said first section is defined longitudinally and laterally beyond said inner end panel of said first section.

12. The corner post of claim 8 wherein said first section is defined longitudinally and laterally beyond said inner end panel of said first section.

13. A corner support post for the cushioning protection of a packaged product, said support post having a length and a width and being defined by a continuous wall structure, said post including a first section of trapezoidal configuration with parallel inner and outer end panels and converging side panels defined by said wall structure, and a second section of rectangular configuration defined by said wall structure and extending laterally and longitudinally beyond said inner end panel of said first section.

14. The corner support post of claim 13 wherein said outer end panel of said first section defines the lateral extent of said post, said second section being within the lateral extent defined by said outer end panel.

15. The corner post of claim 14 wherein said second section includes a side panel defined by said wall structure and extending at substantially a right angle from said inner end panel of said first section.

* * * * *